United States Patent [19]

Kay et al.

[11] 4,397,396

[45] Aug. 9, 1983

[54] TRUCK CRANE HAVING AN ELONGATED MAIN FRAME

[75] Inventors: Christopher G. Kay, Roseville, Minn.; John M. Lanning, Solon, Iowa

[73] Assignee: Harnischfeger Corporation, West Milwaukee, Wis.

[21] Appl. No.: 203,941

[22] Filed: Nov. 7, 1980

[51] Int. Cl.[3] ..... B66C 23/36

[52] U.S. Cl. ..... 212/189; 212/195; 212/223

[58] Field of Search ..... 212/195, 223, 230, 245, 212/253, 170; 280/763–766, 786, 797

[56] References Cited

U.S. PATENT DOCUMENTS

| | | | |
|---|---|---|---|
| 3,622,171 | 11/1971 | Gottschalk | 280/797 |
| 3,854,595 | 12/1974 | Kuhn | 212/189 |
| 4,160,558 | 7/1979 | Fritsch | 280/797 |
| 4,177,869 | 12/1979 | Crabiel | 212/253 |

FOREIGN PATENT DOCUMENTS

| | | | |
|---|---|---|---|
| 359531 | 9/1922 | Fed. Rep. of Germany | 212/189 |
| 1215223 | 12/1970 | United Kingdom | 280/765 |

*Primary Examiner*—Sherman D. Basinger
*Attorney, Agent, or Firm*—James E. Nilles

[57] ABSTRACT

A mobile truck crane having an elongated main frame that forms the carriage for the crane as well as forming a fore and aft elongated outrigger for stabilization in the crane operative position. A pair of transversely swingable outriggers are attached intermediate the length of the main frame and act to stabilize the crane in transverse directions. The main frame is formed of rectangular tubular cross section and is of such shape as to have a high strength-to-weight ratio and which is particularly rigid and capable of transmitting high, concentrated loads in an efficient manner from a revolvable upper that includes a telescoping boom. The main frame includes an intermediate tub which is fabricated to transmit loads from the upper superstructure to all four outriggers of the main frame. The crane finds particularly utility when used as a mobile truck crane of the self-propelled type in which the power source is located on the upper, revolvable superstructure and which provides power through a right angle drive downwardly through the tub and to a power transmission located at the underside of the main frame for furnishing driving power to the ground engaging wheels. The superstructure of the crane includes a cantilevered framework overhanging one side of the superstructure and on which are mounted essential parts of the crane, such as the engine, air and fuel tanks, compressor, winches, and conventional counterweights are not required for counterbalancing the telescoping boom which extends from a side of the superstructure opposite that of the cantilevered framework.

21 Claims, 27 Drawing Figures

TRUCK CRANE HAVING AN ELONGATED MAIN FRAME

BACKGROUND OF THE INVENTION

The present invention pertains to truck cranes, particularly those of the self-propelled mobile type and having a revolvable upper from which extends a telescoping boom. These prior art devices have various types of main frames and combinations of fore and aft and transverse outriggers for stabilizing the crane when in the boom operative position. Examples of such prior art devices are shown in the U.S. Pat. No. 3,854,595 issued Dec. 17, 1974 to Kuhn, which discloses a truck crane having a center portion from which transversely extending outriggers can swing and otherwise utilize a conventional undercarriage; U.S. Pat. No. 2,914,194 which issued Nov. 29, 1959 to Brown and which also utilizes a conventional undercarriage frame; and U.S. Pat. No. 4,160,558 of July 10, 1979 to Fritsch which utilizes mid-mounted, scissors type outriggers and a rectangular cross-section main frame.

SUMMARY OF THE PRESENT INVENTION

The present invention provides an improved elongated main frame for a truck crane, which frame is of tubular rectangular cross sectional shape and which has an intermediate tub along the length of the frame. The main elongated frame acts not only as a chassis for the truck crane, but also acts as an elongated outrigger having a ground engaging jack at both its front and rear ends for stabilizing the crane in fore and aft direction when the boom is operative. A transversely swingable outrigger is located on each of opposite side of the tub for stabilizing the crane in a transverse direction. The invention provides a main frame of the above type wherein the tub and the front and rear portions of the main frame are fabricated in such a manner to provide a high strenght/weight ratio capable of transmitting heavy concentrated loads efficiently and effectively to the four outrigger stabilizers.

A more specific aspect of the invention relates to a truck crane of the above type having a transmission located along its underside for delivering power to ground engaging wheels and for receiving power through the tub of the main frame and from a power source located on a revolvable superstructure on top of the main frame. An extensible boom is vertically positionable from one side of the superstructure while the other side of the superstructure has an overhanging framework in which the power source, tanks, compressor and winches and other essential components of the crane are located and which all act to counter-balance the boom that extends from the other side of the superstructure.

Another more specific aspect of the invention relates to such a tank crane wherein the power drive from the power source on the superstructure is a universally joined right angular gear drive through the tub and to the power transmission located at the underside of the main frame, and a rotary connector is also located in the tub and around the power drive and which furnishes compressed air and electric power between the superstructure and the main frame.

These and other objects and advantages of the present invention will appear hereinafter as this disclosure progresses, reference being had to the accompanying drawings.

DESCRIPTION OF THE PREFERRED EMBODIMENT

General Organization

Figure 1:
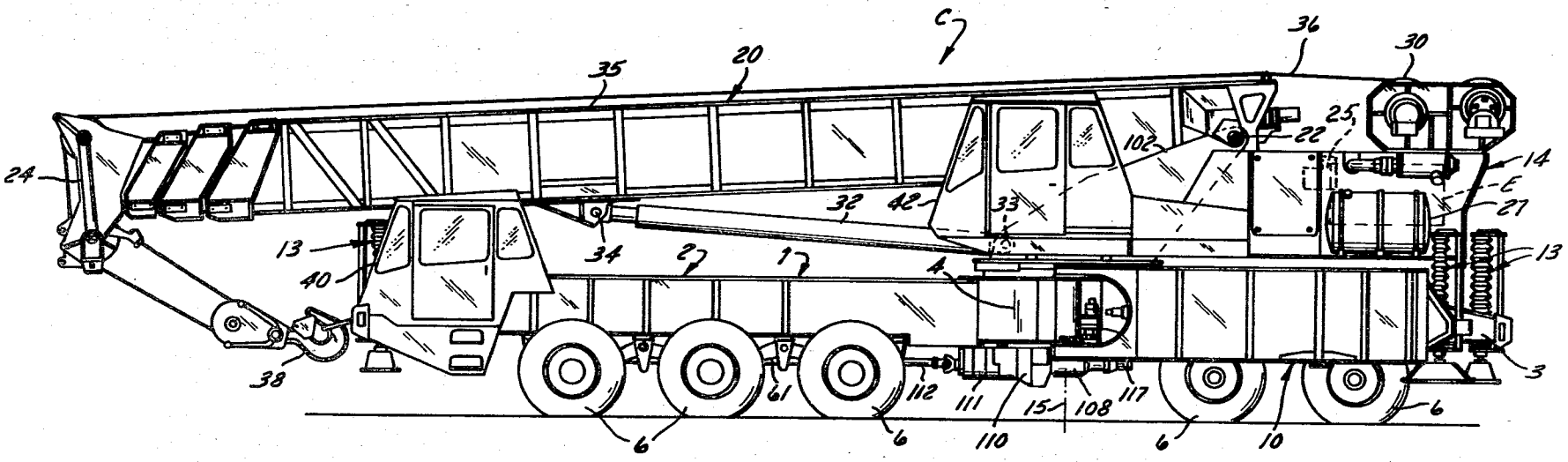
FIG. 1 is an elevational view taken from the left side of a truck crane embodying the present invention, with the outriggers swung to the position alongside the main frame, the crane being shown in the transport mode.
Figure 2:
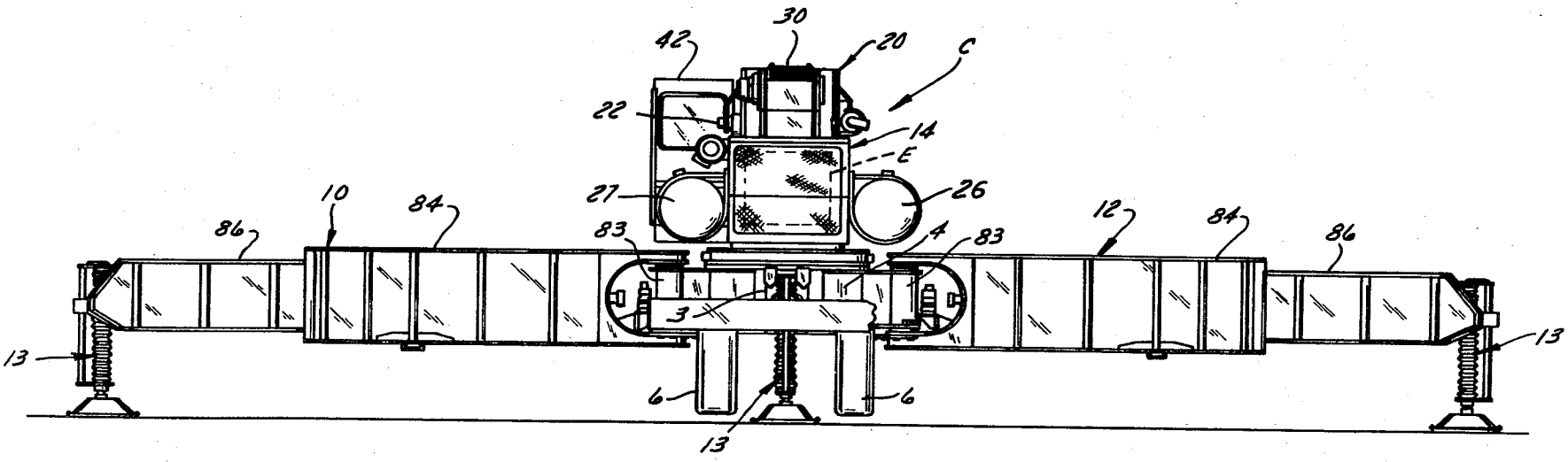
FIG. 2 is a rear view of the crane shown in FIG. 1, but showing the transverse outriggers swung outwardly and all four outriggers jacks in the ground engaging crane operative position.
Figure 9:
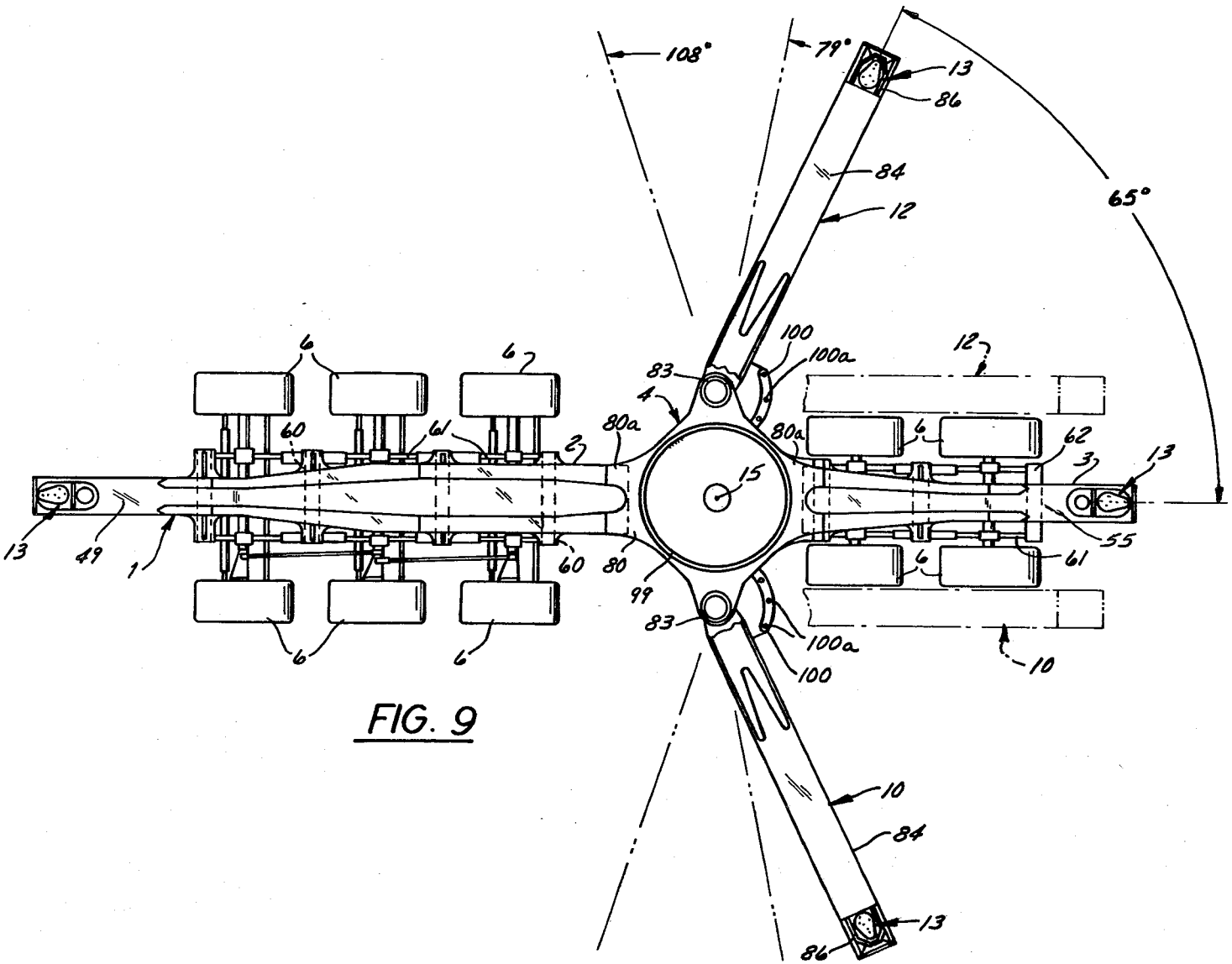
FIG. 9 is a plan view of the main frame made in accordance with the present invention and showing the transverse outriggers in the outwardly extending position and also showing the ground engaging means in the form of wheels for the crane of the present invention.

The general organization of the self-propelled truck crane C embodying the present invention is shown in FIGS. 1 and 2 and includes an elongated main frame 1 comprising a tubular front portion 2 and a tubular rear portion 3 which are both of rectangular transverse cross section and fabricated from steel plates that are welded together. The main frame also includes an intermediatly located tub 4 to which adjacent ends of the front and rear portions are welded to form a unitary main frame. Ground engaging means 6 in the form of wheels are located and attached to the lower portion of the main frame whereby the crane can be transported from job site to job site over the highway or other terrain. A pair of transversely extendible outriggers 10 and 12 are extendible from the left and right sides of the main frame and more particularly are pivotably connected to their respective sides of the tub of the main frame as will appear in more detail. These outriggers are swingable from the transport position shown in FIG. 1 where they extend generally parallel with the main frame and alongside thereof and any one of a number of transversely extending positions outwardly of the main frame, such as shown in FIGS. 2 and 9 for stabilizing the truck crane when the boom is in operation.

A vertically extendible ground engaging jack 13 is located at each of the forward and rearward ends of the main frame and also at each of the outer ends of the two outriggers, thus providing four widely spaced apart jacks for stabilizing the crane against tipping when the boom is in the working position.

Figures 23, 24:
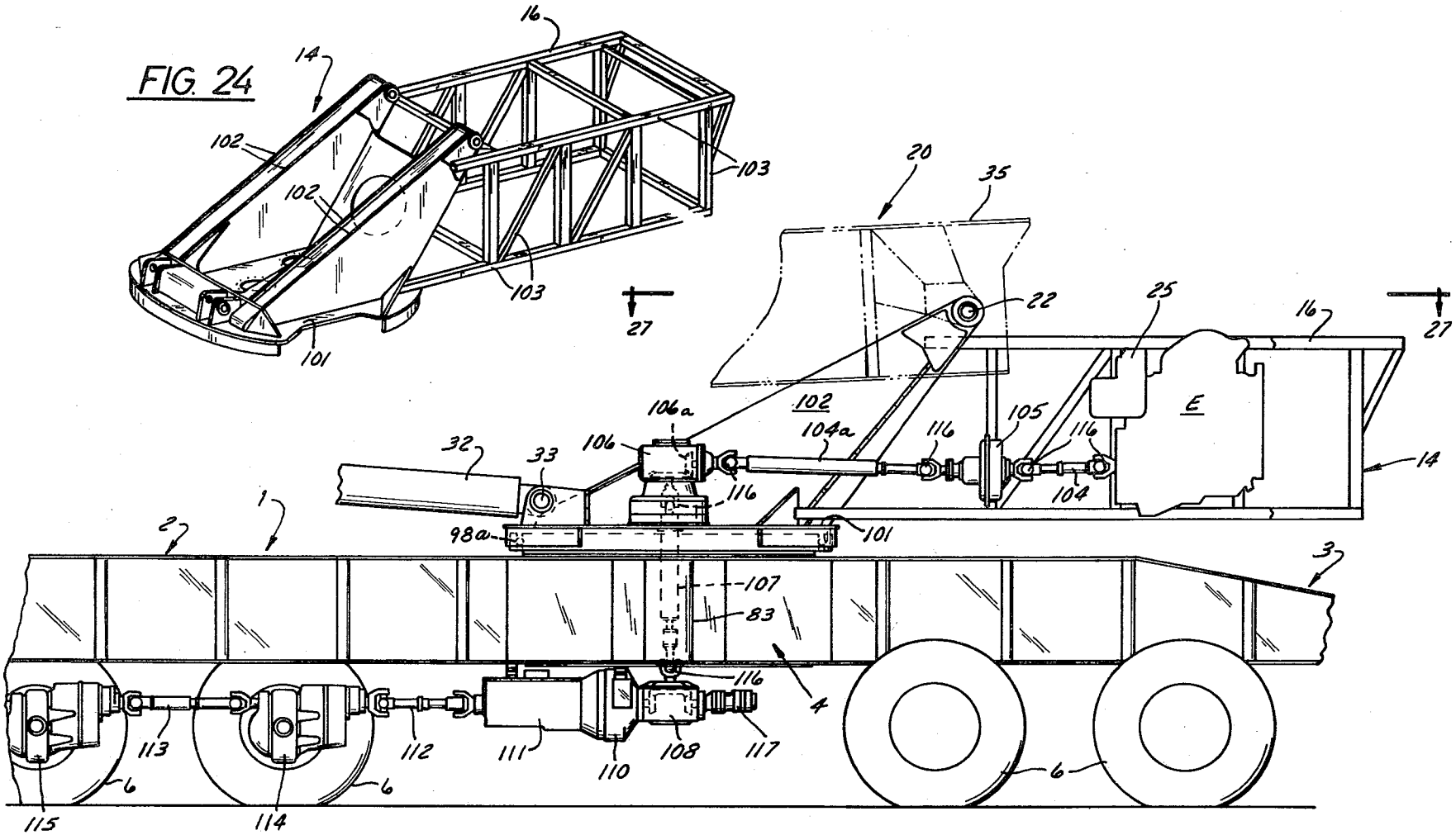
FIG. 23 is a side elevational view of a portion of the main frame with certain parts removed or broken away from the sake of clarity and showing the upper structure including the cantilevered framework for supporting the power source and also showing the power transmission for driving the ground engaging wheels and the power connection between the transmission, and the power source.
FIG. 24 is a perspective view of the superstructure and its framework as shown in FIG. 23.

The crane also includes a superstructure 14 which is rotatably mounted about a vertical axis 15 on the upper portion of the tub and is capable of rotating 360 degrees. This susperstructure as shown in FIG. 23 includes a cantilevered framework 16 that overhangs from one side of the superstructure. An extendible, telescoping boom 20 is pivotable about a horizontal shaft 22 at the upper end of the superstructure so that the boom can be vertically positioned about the horizontal axis 22. The boom is comprised of several telescoping sections so that its free end containing the boom point 24 (FIG. 1) can be extended many feet into the air. It will be noted that the boom 20 extends from that side of the superstructure which is opposite to the side of the superstructure from that which the framework 16 extends. Certain essential elements of the crane are mounted on the superstructure such as the power source E which may take the form of an internal combustion engine, air compressor 25, fuel tank 27, hydraulic tank 26, (FIGS. 1 and 2), winches 30, and other relatively heavy conventional equipment. In this manner, the engine E and other relative heavy components act to counterbalance the weight of the boom which extends from the other side of the superstructure, as will more fully appear later.

The boom itself may be of conventional construction and a further description of it is deemed to be neither necessary nor desirable except to say that when fully extended on a crane with which the present invention finds particular utility, it may reach a height of several hundred feet. The boom is raised and lowered to any desired angle by the large hydraulic cylinder 32 pivoted about a horizontal axis 33 to the superstructure and also pivoted at its forward end at 34 (FIG. 1) intermediate the length of the base section 35 of the boom. A load line 36 extends from the winch 30 over conventional hook 38 in the known manner.

An operator's cab 40 is located on the front end of the main frame and in which the operator is located for driving the crane in the transport mode. Another operator's cab 42 containing appropriate controls, is located on the superstructure and is used for operating various components of the boom and crane when the crane is in the operating mode.

MAIN FRAME

Figure 4:
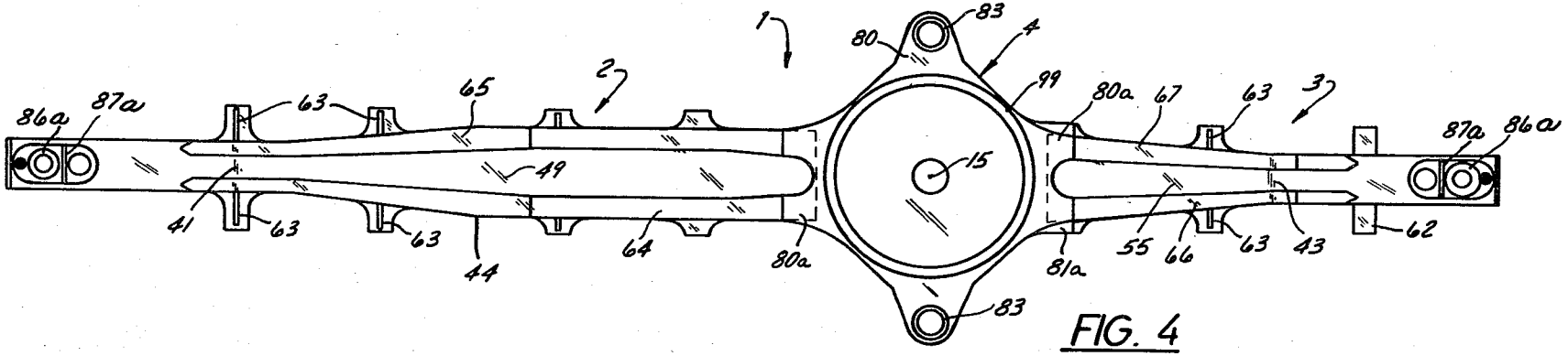
FIG. 4 is a plan view of the main frame shown in FIG. 3.
Figure 3:
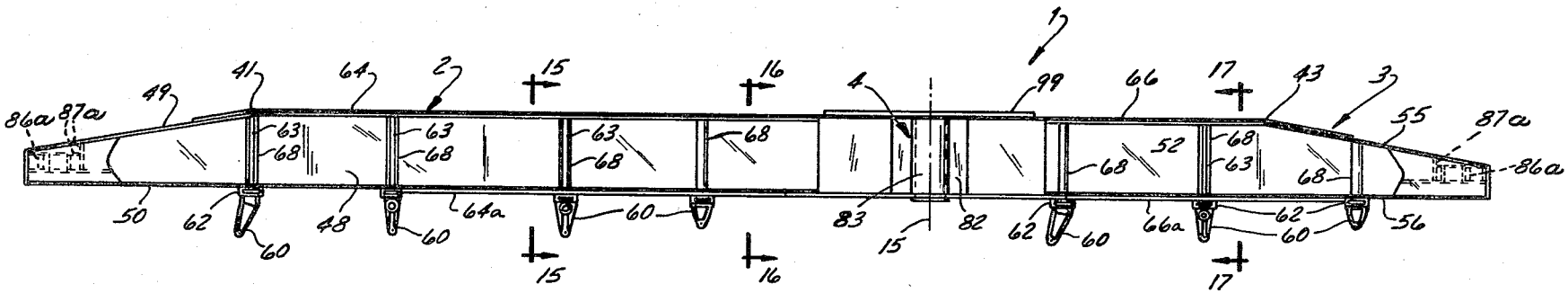
FIG. 3 is a left side elevational view of the main frame of the crane.

Referring again to the elongated main frame 1, (FIGS. 3, 4 and 9), the front portion 2 is longer than the rear portion 3, the portion 2 being for example, a length of 300 inches from the vertical axis 15, while portion 3 is about 180 inches in length from axis 15. Both portions 2 and 3 generally taper to a smaller transvere cross-sectional area toward their outer ends, thereby insuring uniform stress and strength along the portions from the tub 4 and outwardly toward the outer ends. As shown in FIG. 3, the front portion 2 has its upper surface inclined from point 41 downwardly in an outward direction and portion 3 is inclined downwardly as its upper side from point 43. As shown in FIG. 4, the frame portions also taper inwardly, for at least a portion of their length, as they extend in an outwardly direction; portion 2 being tapered from point 44 while shorter portion 3 is tapered generally along the major part of its length.

The entire truck crane provided by the present invention and particularly its main frame is constructed to give a particularly high strength-to-weight ratio and a crane is provided having exceptional reach and load carrying capabilities taking into consideration the weight of the crane.

As a result, the crane is capable of rapid transport over the highways and at the same time provides exceptional stability and use, particularly when the boom is fully extended. The weight and overall width of the crane also meet existing standards for highway travel.

Figure 6:
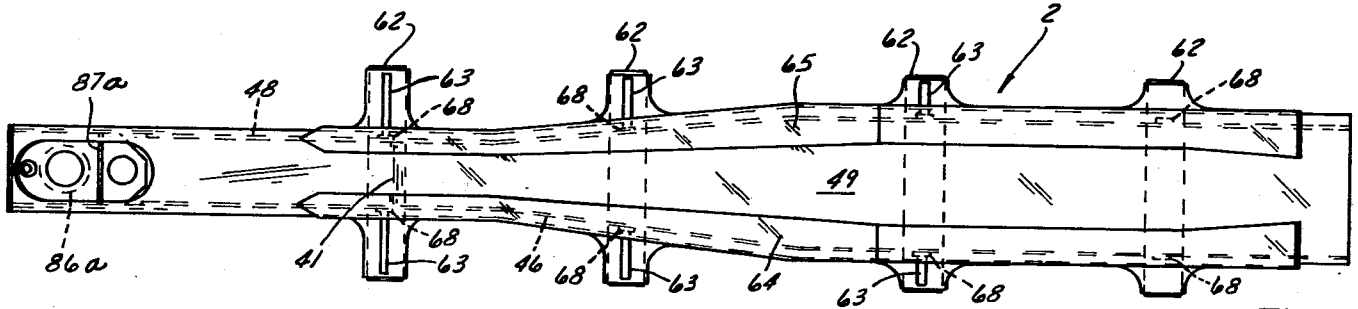
FIG. 6 is a plan view of the front portion of the frame shown in FIG. 5.
Figure 5:
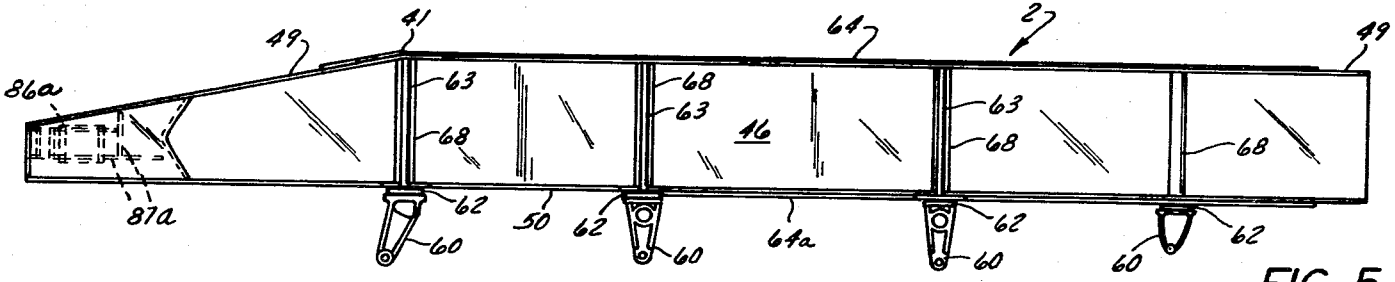
FIG. 5 is a left hand elevational view of the front portion of the main frame shown in FIG. 3, but on a slightly enlarged scale.
Figure 8:
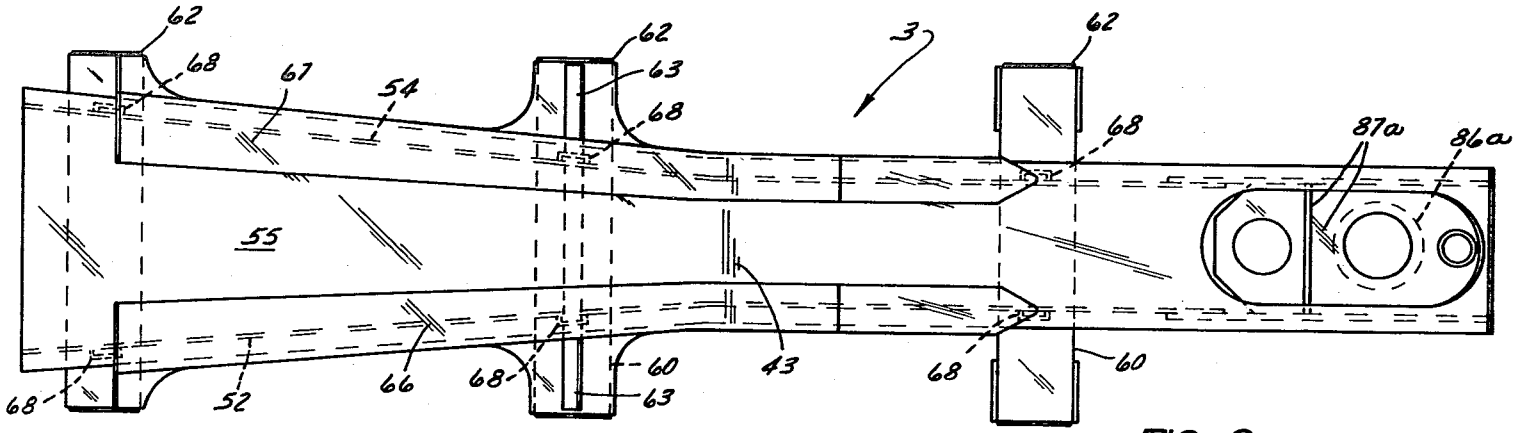
FIG. 8 is a plan view of the rear portion of the main frame shown in FIG. 7.
Figure 7:
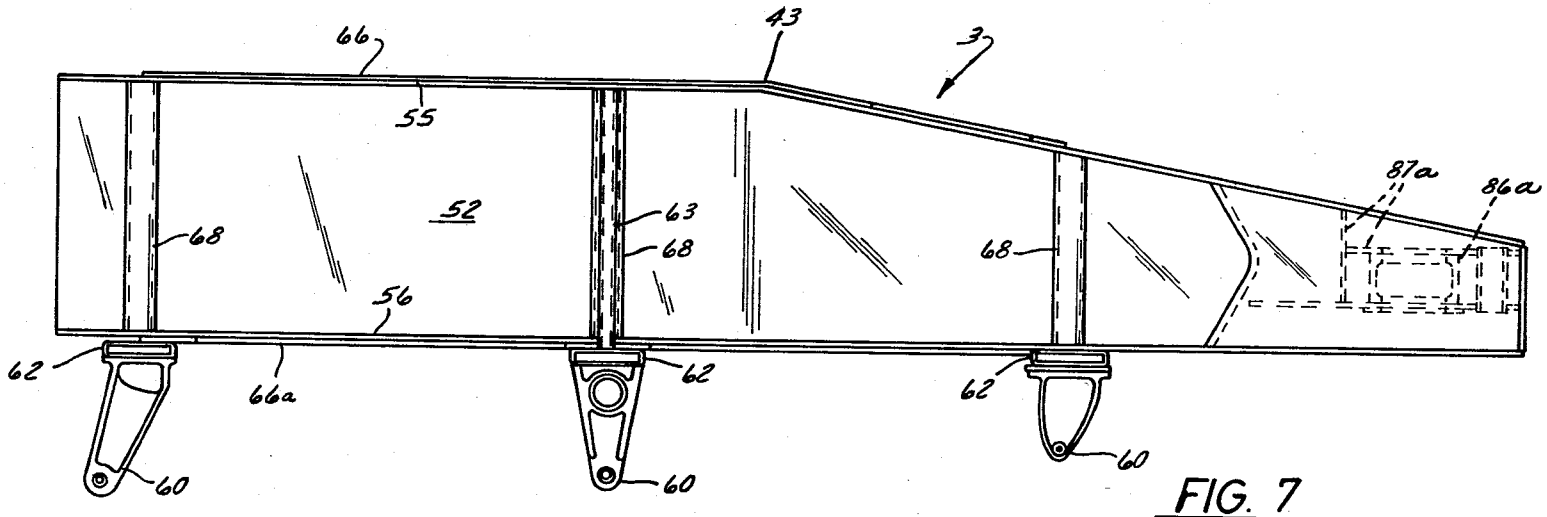
FIG. 7 is a left side elevational view of the rear portion of the main frame shown in FIG. 3, but on an enlarged scale.
Figure 15:
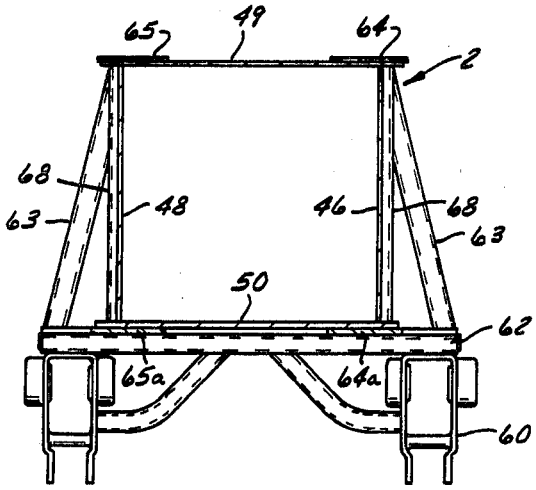
FIG. 15 is a transverse sectional view taken along the line 15—15 in FIG. 3, but on an enlarged scale.
Figure 16:
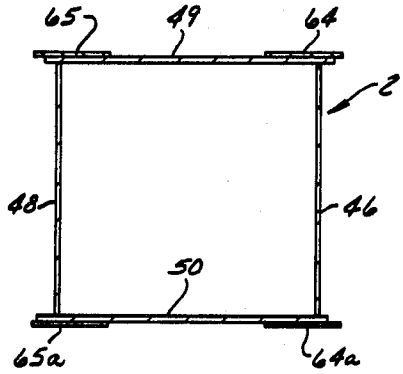
FIG. 16 is a transverse sectional view taken along the line 16—16 in FIG. 3, but on an enlarged scale.
Figure 17:
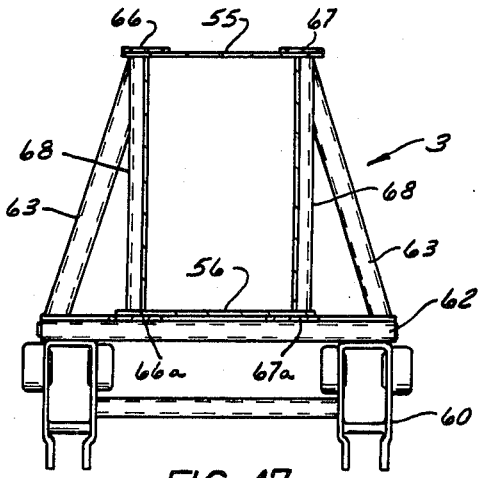
FIG. 17 is a transverse sectional view taken along the line 17—17 in FIG. 3, but on an enlarged scale.

Referring to FIGS. 5 and 6, the front portion of the main frame has a pair of horizontally spaced apart, vertical plates which form side walls 46 and 48 which extend along the entire length of the front portion. A top plate 49 and a bottom plate 50 are provided which are welded to the adjacent edges of the side walls along the entire length of the front portion, thereby forming a tubular, rectangularly shaped front portion 2. The rear portion 3 is similarly constructed having a vertical side walls 52 and 54 which are welded to the top plate 55 and bottom plate 56. Attaching means 60 are secured along the lower side of the frame portions for attaching the ground engaging wheels 6 by means of conventional resilient mounting means 61 (FIG. 1) which are secured to the brackets 60. The brackets 60 are secured to cross braces 62 (FIG. 15, 17) that in turn are rigidly braces by downwardly and outwardly included struts 63, all suitably welded together.

It will be noted that each of the front and rear portions have reinforcing plates welded along both their upper and lower plates and along each of the outer edges thereof. More specifically reinforcing plates 64 and 65 are welded on upper plate 49, and shorter reinforcing plates **64*a* and 65*a* are welded on the lower plate 50 of the front portion (FIG. 5 and 6). On the rear portion, reinforcing plates 66 and 67 are welded on the upper plate 55, adn shorter plates 66*a* and 67*a* are welded on the lower plate 56, (FIGS. 7, 8 12 and 13**). These reinforcing plates extend along the major part of the length of their respective frame portions and converge or diminish in their width as they approach the outer ends of said frame portions.

Relatively thin plates can be used for fabricating portion 2 and 3 along with the use of vertical, channel shaped stiffeners 68 which are welded to the thin side walls at spaced locations along their length.

A particularly high-strength-to-weight ratio is obtained with the above construction for the front and rear portions of the frame including the combination of having the frame portions diminish in cross sectional area, namely in width, as they approach the outer ends of the frame portions to which they are welded. When the crane is under-load, the upper reinforcing plates are placed under compression and a good section modulus for the frame portions are provided to maintain uniform stress along the length thereof. The reinforcing plates also strengthen the corners of the frame portions and by providing uniform stress enable the weight of the main frame to be held to a minimum for the loads to which it is subjected. A desirable stiffness and strength/weight ratio is obtained which is constant along the length of the frame portions, resulting in a weight of about 163 pounds per foot.

The particularly shape and designed rectangular cross section main frame contributes to being able to limit the overall height to the machine by permitting the use of a transmission drive system for the ground wheels that is located beneath the main frame, and accommodate the axles of the ground wheels and the transverse swinging of the outriggers.

Figure 10:
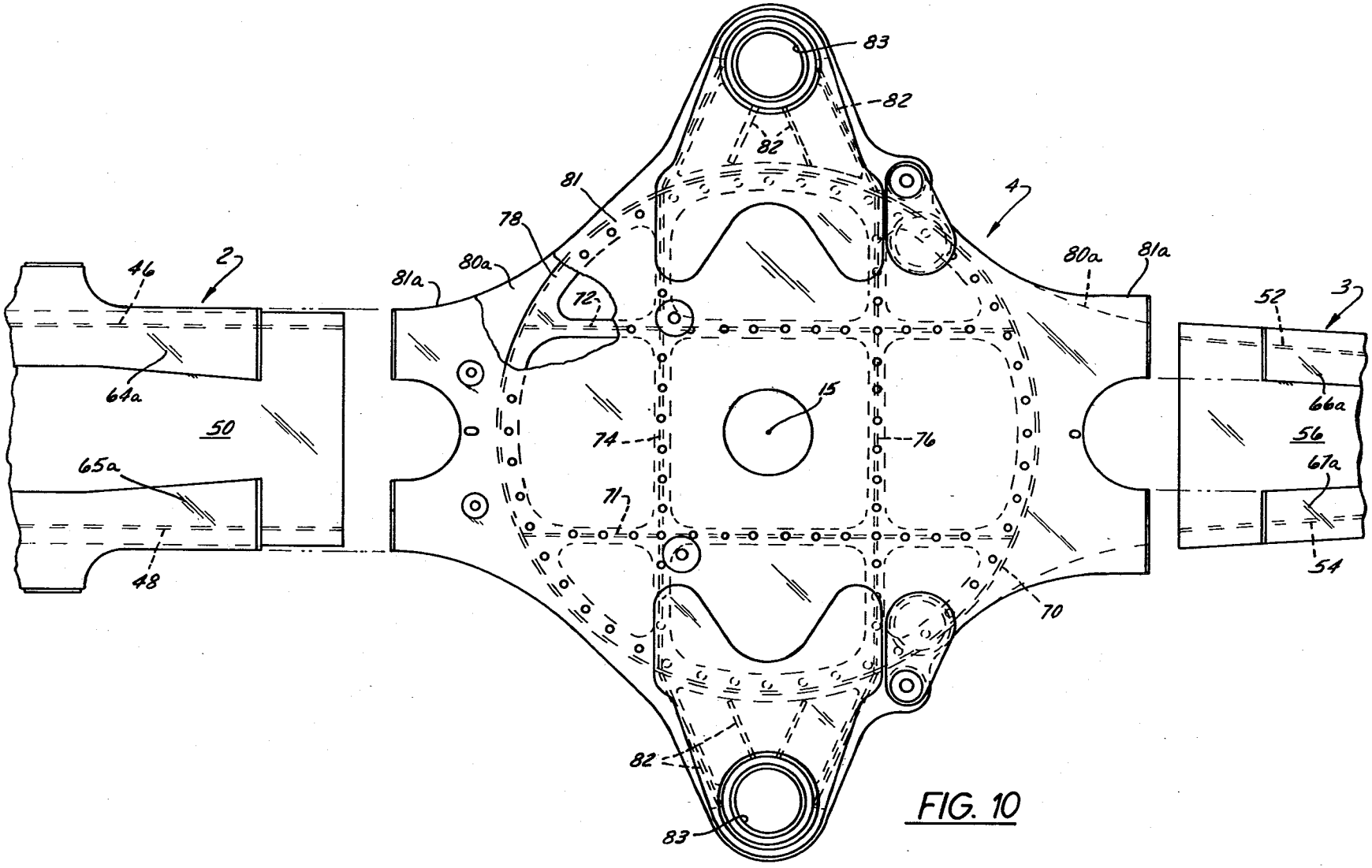
FIG. 10 is an enlarged bottom view of the central portion of the main frame and showing the tub with certain parts broken away for the sake of clarity and showing a part of the front and rear portion in exploded view from the tube.
Figures 11, 12, 13:
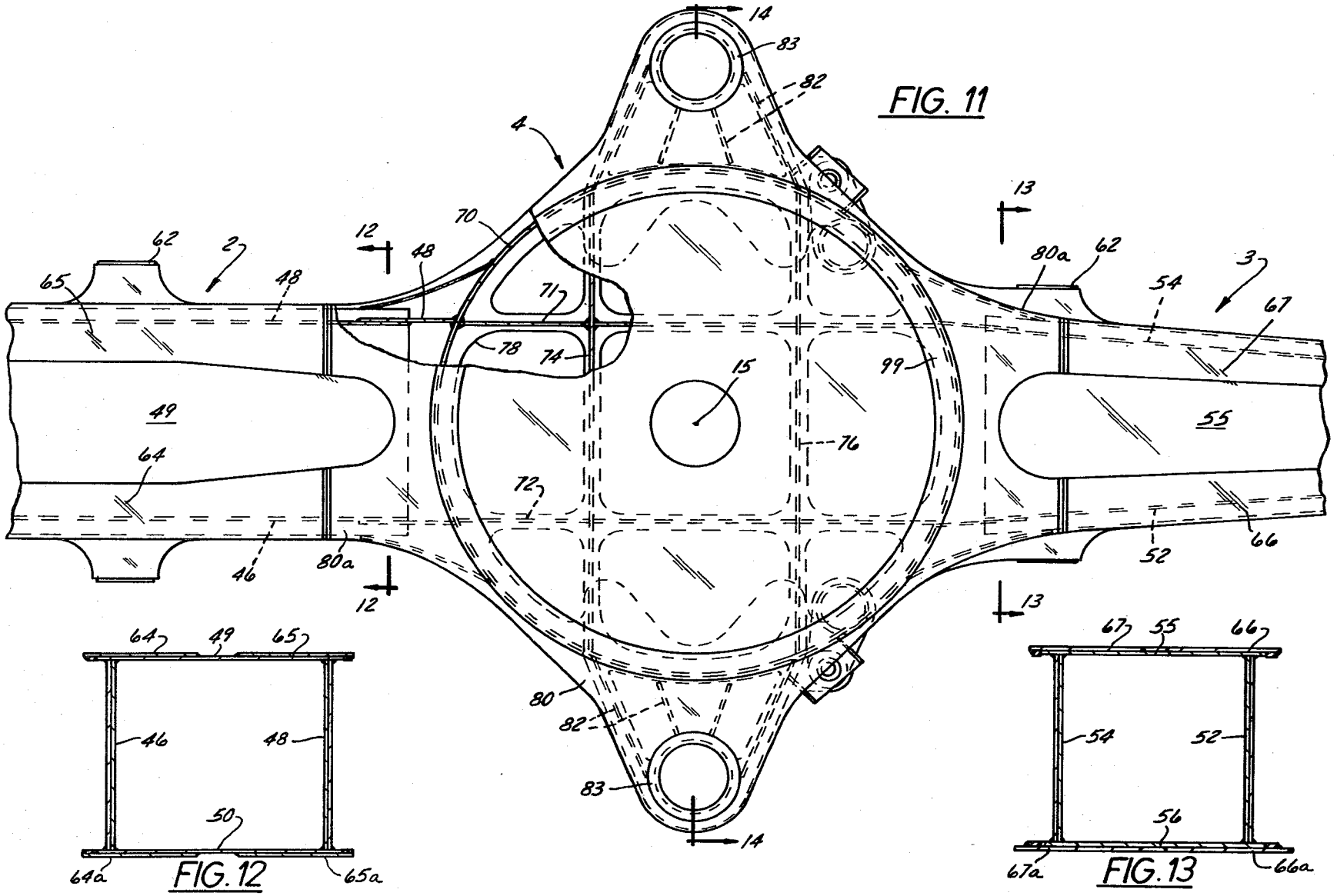
FIG. 11 is a fragmentary, plan view of the central portion of the main frame when the front and rear portions are assembled to the tub and furthermore showing a portion of the upper plate of the tub broken away for the sake of clarity in the drawings.
FIG. 12 is a transverse, cross sectional view taken along the line 12—12 in FIG. 11 and showing the tubular rectangular construction of the front portion of the main frame.
FIG. 13 is a transverse sectional view taken along the line 13—13 in FIG. 11 and showing the tubular rectangular cross sectional shape of the rear portion of the frame.
Figure 14:
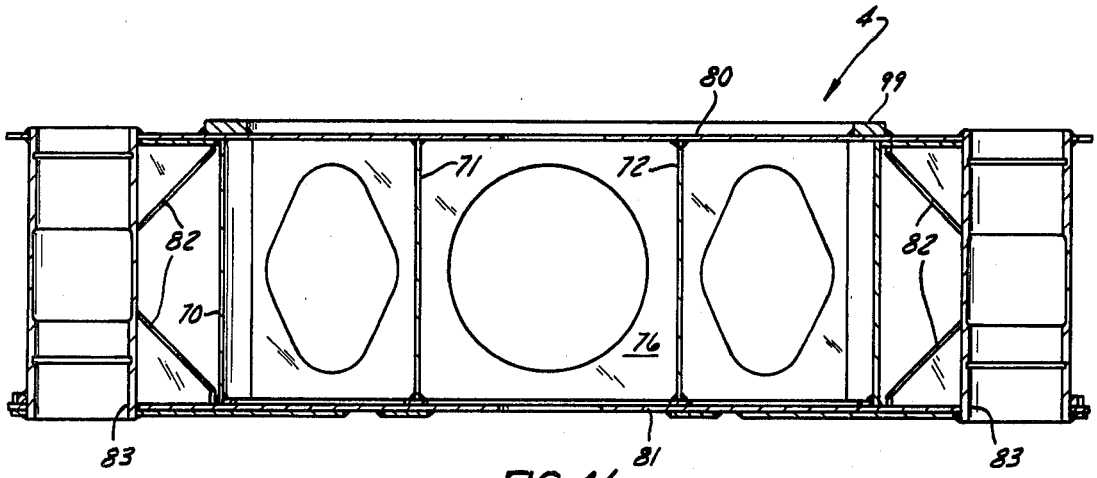
FIG. 14 is a transverse, vertical sectional view taken through the tub of the main frame and generally along the line 14—14 in FIG. 11 and showing the means for pivotably mounting the transverse outriggers and also showing the inner plate construction of the tub.

The main frame includes the tub 4 to which the adjacent ends of the front and rear portions of the main frame are welded, as best shown in FIGS. 10 and 11. The tub is fabricated from steel and includes a cylindrical steel member 70 having its longitudinal axis 15 disposed in a vertical direction, that is to say, the tub is circular when viewed in plan. A pair of spaced apart vertical plates 71 and 72 extend longitudinally across and are welded to the interior of the cylindrical steel member as shown. It will be noted that the pair of spaced apart vertical side walls 46 and 48 of the frame front portion 2 and the pair of horizontally spaced apart side walls 52 and 54 of the frame rear portion 3 are in longitudinal alignment with the vertical plates 71 and 72 in the tub, which together form a pair of continuous vertical side walls along the length of the main frame. The side walls of the front and rear portions are welded to the outer surface of the tub. The tub of the main frame is furthermore provided with exceptional strength for its weight and is capable of sustaining and transmitting the heavy concentrated loads to which it is subjected by the use of another pair of spaced apart transverse vertical plates 74 and 76 which extend transversely within the cylindrical tub and intersect and are welded to the longitudinally extending vertical plates 71 and 72 in the tub. The transversely extending plates 74 and 76 are also welded to the interior of the cylindrical member 70. The tub also includes a horizontal, lower reinforcing plate 78 (FIG. 19) which is welded to the lower portion of the cylindrical member 70 to further strengthen the tub construction.

Figures 18, 19:
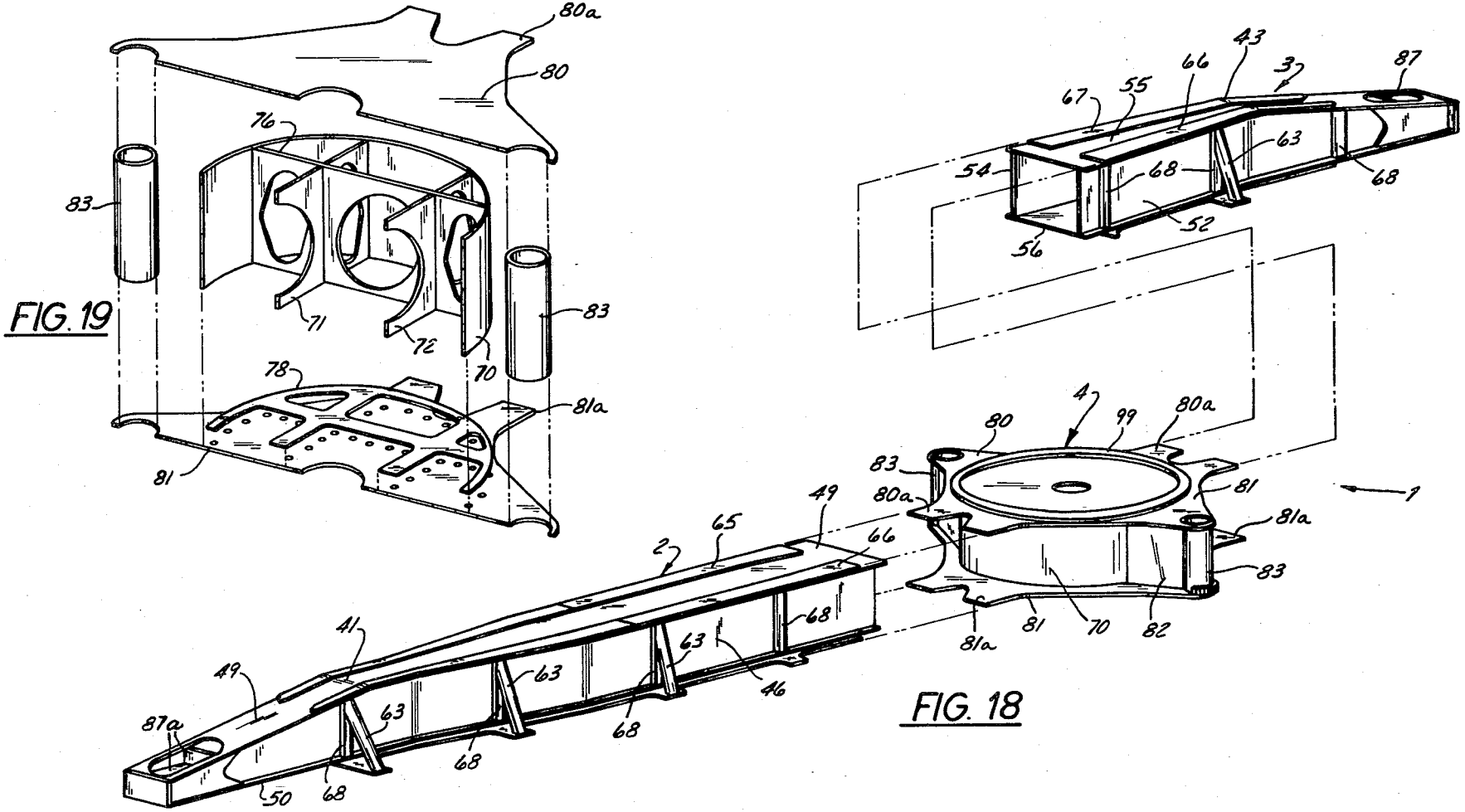
FIG. 18 is a perspective, exploded view of the main frame and showing the front portion, the tub and the rear portion of the main frame.
FIG. 19 is a fragmentary exploded perspective view of the tub construction and showing the cylindrical steel member and the pairs of vertical, intersecting plates and the lower reinforcing plate.

Certain portions have been cut away from the plate 78 as well as from the vertical plates within the tub, as shown in FIG. 19 to reduce the weight where possible without sacrificing strength.

The tub construction also includes a horizontal top plate 80 and a horizontal bottom plate 81 which both extend transversely beyond each side of the tub, these top and bottom plates being welded to the upper and lower ends of the cylindrical member 70 to form a rigid, unitary construction. As shown in FIGS. 10, 11, 14 and 18, additional steel gusset plates 82 are provided between the upper and lower plates 80 and 81 and are welded thereto. The top and bottom plates 80 and 81 of the tub also have (FIGS. 10, 11, 18 and 19) extentions **80*a* and 81*a* extending in front and rear directions, respectively. These extensions overlap the inner ends of the front and rear portions of the main frame and abut endwise against the reinforcing plates (FIG. 11**).

A steel tube 83 is welded between plates 80 and 81 at each side of the tub to provide a pivotable mounting means for moutning out-riggers (to be described) at each side of the main frame.

The vertically positionable ground engaging jack 13 provided at both the front and rear ends of the main frame, are positionable between a lower ground engaging position when the crane is in load handling mode and an upper position clear of the ground when the crane is in the transport mode.

Means, (FIGS. 5 and 6) are provided at the outer ends of the main frame for mounting these jacks and this means includes the tubular bearing **86*a* rigidly welded in the support plates 87*a*** located between the side walls of the frame portions. The construction and power operation of these jacks is shown in the co-pending application Ser. No. 203,943, filed Nov. 7, 1980 concurrently with the present application on and reference may be had to that application if a further description of the construction and operation of these jacks is deemed to be either necessary or desirable.

The main frame provided by the present invention is thus of elongated and relatively narrow shape, being of rectangular tubular cross section and diminishing in cross-sectional size towards the outer ends of the main frame.

The main frame forms the main back-bone and acts as a chassis for the truck crane. The frame itself constitutes an outrigger extending in both forward and rearward directions when its jacks 13 are extended downwardly to stabilize the crane against fore and aft tipping.

With the front and rear portions construction as above described, as well as the above tub construction, the thrust and moment loads imposed on it are transferred directly to the ground through the front and rear ends of the main frame and also through the two transversely positionable outriggers now to be described.

TRANSVERSE OUTRIGGERS

Figure 20:
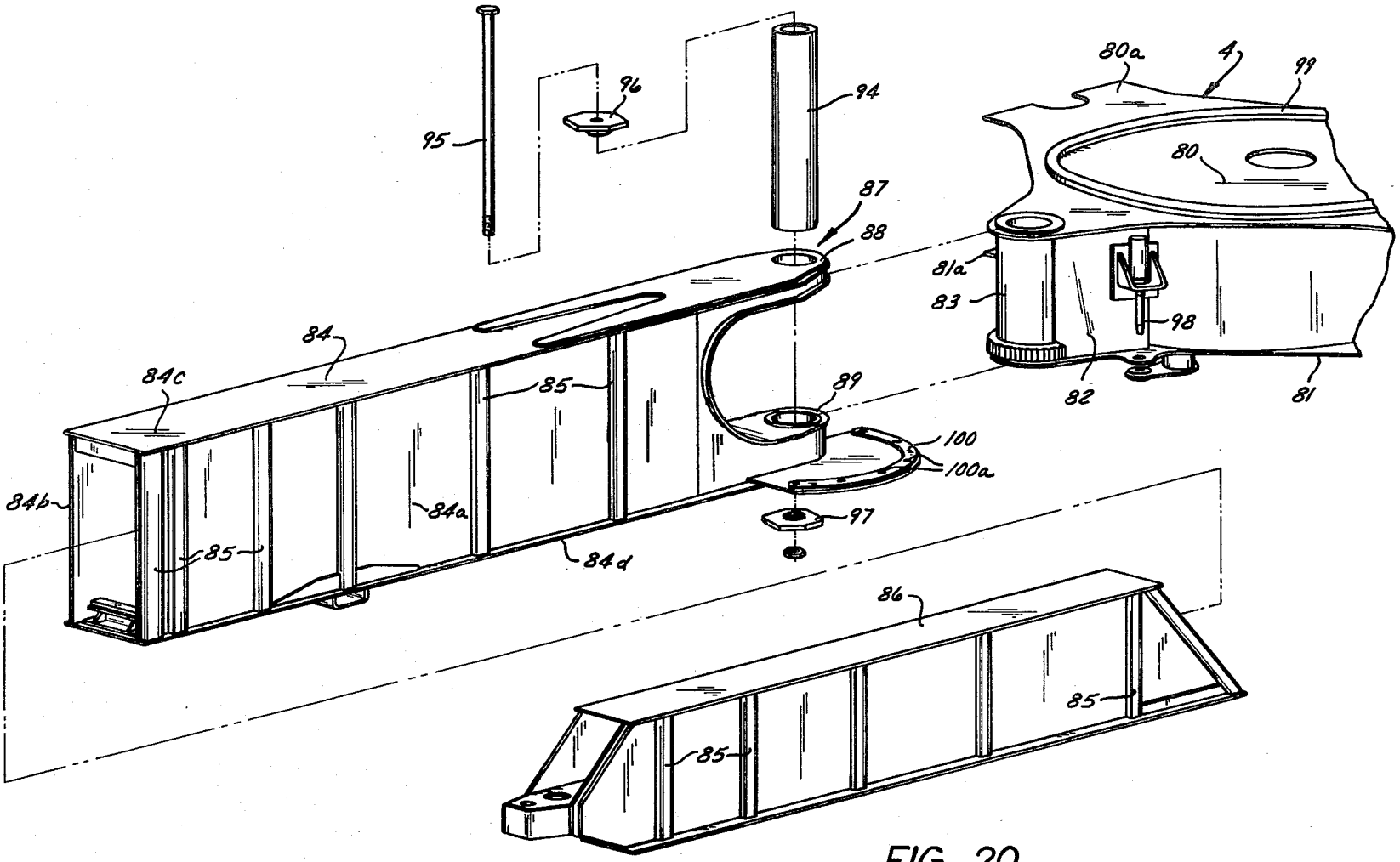
FIG. 20 is a perspective, exploded view of a portion of the tub and a transverse telescoping outrigger.
Figure 21:
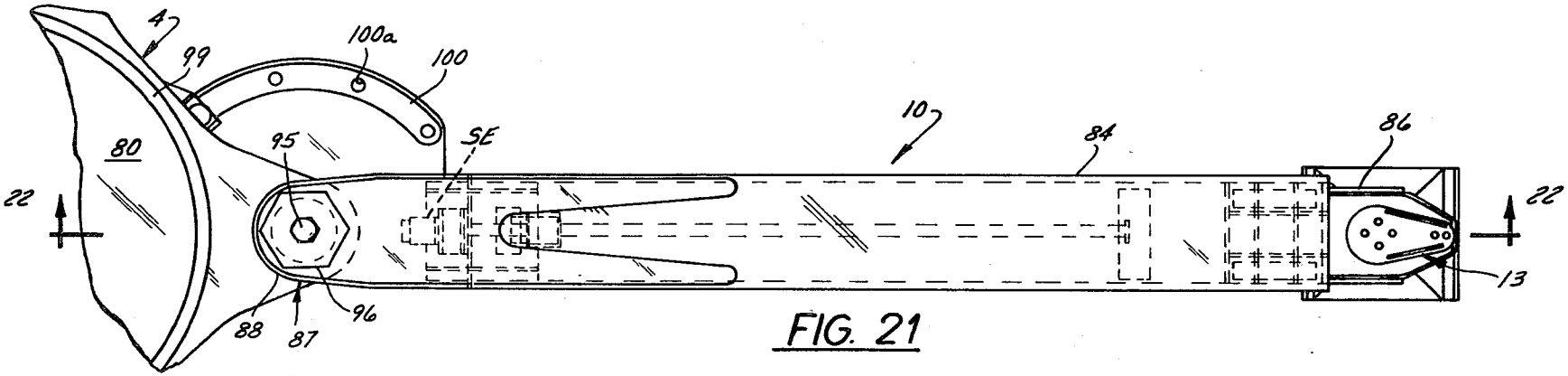
FIG. 21 is a plan view of the telescoping outrigger attached to the tub.
Figure 22:
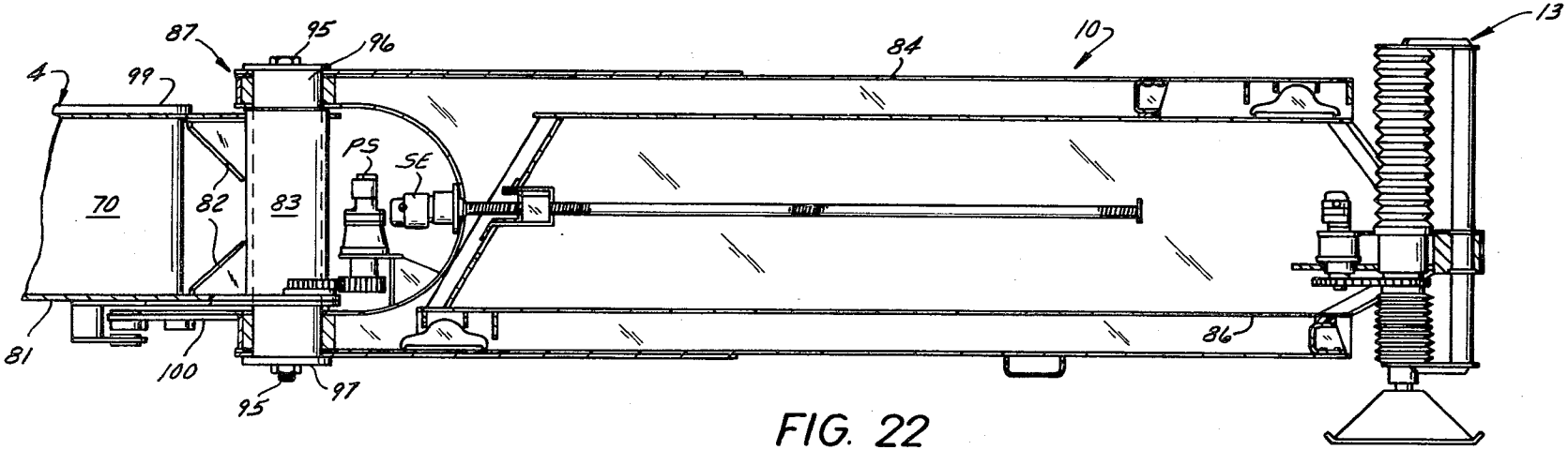
FIG. 22 is a vertical sectional view taken along line 22—22 in FIG. 21.

The transverse outriggers 10 and 12 are identical in construction and reference will be made to only one of them. The outrigger 10 is shown in detail in FIGS. 20–22 and includes an outer generally hollow and elongated box 84 and an elongated inner beam 86 telescopingly mounted within the box 84. The box is formed of steel plates, namely side plates 84*a* and 84*b* and top and bottom plates 84*c* and 84*d*, all welded together. Vertical channel shaped stiffeners 85 are welded at spaced intervals along the side walls. Beam 86 is constructed generally similarly to box 84.

Box 84 of each of the outriggers has an inner end 87 pivotally connected about a vertical axis to the tub as follows. The inner end 87 of the outrigger is bifurcated into an upper part 88 and a lower part 89 and a pivot shaft 94 extends through aligned holes in the upper and lower parts and also through the tube 83 that extends through the sides of the tub. Bolt means 95 together with upper and lower caps 96 and 97 which are located on the ends of shaft 94 act to secure the shaft 94 in assembled relationship.

It will be noted that box inner end parts 88 and 89 extend over and embrace the upper and lower surfaces of the tub. The parts 88 and 89 are thus vertically spaced apart a considerable distance to provide a stable, pivotable connection for the outriggers to the tub. The bifurcated inner ends of the outriggers act to brace the tub and give widely spaced support in a vertical direction and good load carry ability of the outrigger. In operation, as the outriggers are loaded, a shear load is imposed which is applied at the bifurcated, yoke connection to the tub. The bifurcated construction of the inner end of the outrigger along with the pivot shaft extending therethrough prevents the bifurcated end from opening or spreading when the load is applied. The center vertical shaft 94 and bolt means 95 act to distribute the load between the top and bottom bifurcated ends and provides one solid unit with good strength along with the outer transverse portions of the tub.

The construction and mounting of the outriggers of the present invention, that is their vertical pivoted connection for transverse swinging from the main frame together with their telescoping capacity, provide a transverse reach of 300 inches from the center of the frame tub to each side of the crane.

The ground engaging, vertically positionable jacks 13 located at each of the outer ends of the outrigger, namely at the outer end of the beam section 86, can be lowered into the ground engaging position when the boom of the crane is operative in handling loads. These jacks can be elevated clear of the ground when the outriggers are to be swung along the main frame of the crane for ground transport.

As shown in FIG. 9, the outriggers 10 and 12 can be swung to various transverse positions relative to the main frame and locked in any desired position. This locking is accomplished by a power operated plunger 98 located on the tub (FIG. 20) and which plunger is engaged in any one of a number of holes 100*a* located in an arcuate plate 100 and in turn secured to the inner end of the outrigger.

The rear portion 3 of the main frame is shorter than the forward portion 2 which enables the crane to be moved more closely to a building, where necessary, in order for the boom to reach a load on the building, for example.

In operation of the boom, depending on the swing position of the boom when handling the load, the outriggers can be disposed at any one of a number of infinite positions. However, certain optimum transverse positions have been determined for providing maximum stability for the crane, depending on the particular swing area in which the boom is operating.

Due to this non-symmetrical lengths of the front and rear portions of the main frame and also due to the fact that the operator may desire to operate the boom under various circumstances, such as over a 360 degree range, over 180 degrees to the rear of the machine, or, 180 degrees over the front of the machine, the optimum transverse position of the transverse outriggers will vary depending on whch mode of operation is to be used. For example, with the frame construction made in accordance with the present invention, the length of the front portion, that is from the front jack 13 to the center of the tub at 15 where the outriggers are pivoted is about 300 inches. The distance of the rear end of the frame, that is from the center of the tub 15 to the rear jack 13 is about 180 inches. This ratio may vary somewhat depending on the size of the crane, but a good general arrangement is that the pivot point of the outriggers is at a location about 60% closer to the rear end of the main frame than to the front end of the main frame. With a frame of that type, the optimum position of the outriggers are generally at 65 degrees, 79 degrees, and 108 degrees (FIG. 9) measured from the longitudinal centerline of the rear portion of the main frame and these positions of the outriggers provide for maximum stability under the condition of operation chosen. As that portion of the frame is shorter to the rear, from the pivot points of the outriggers, there is least amount of stability in that rearward direction and therefore the outriggers will be positioned slightly to the rear as the said angle of about 65 degrees. When a 360 degree operation of the boom is utilized, then approximately a 79 degree position of the outriggers is preferable. If 180 degrees of rotational boom travel is desired over the rear end of the crane, then 65 degrees position of the outrigger would be desirable. If a boom swing over the front end of the main frame is used, the outriggers would be set at an angle of about 108 degrees from the rear centerline of the frame.

Power driven screw extension means SE (FIG. 22) for extending the telescoping outriggers under power, are shown and described in the U.S. patent application Ser. No. 203,942, filed Nov. 7, 1980, which issued as Patent No. 4,394,912 on July 26, 1983. Power swinging means PS (FIG. 22), for swinging the outriggers to their desired position, are shown in the U.S. patent application Ser. No. 203,944 filed, Nov. 7, 1980, which issued on July 26, 1983, as Patent No. 4,394,913. Reference may be had to those applications which are assigned to an assignee common with the presesnt invention.

SUPERSTRUCTURE

Figure 25:
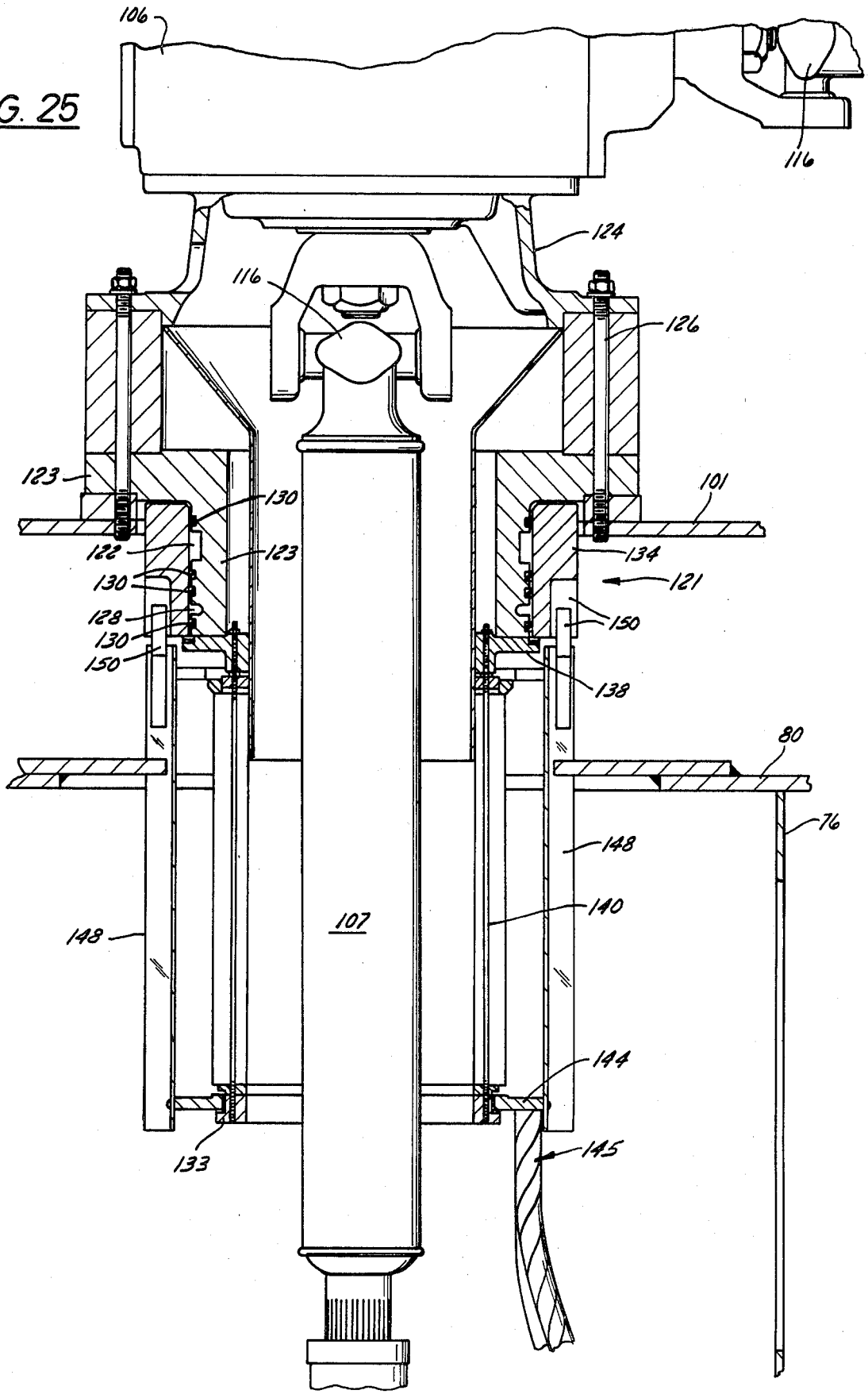
FIG. 25 is a vertical sectional view of the vertically disposed power connection between the transmission and the power source, but on an enlarged scale from that shown in FIG. 23; and also showing the rotary connector for the compressed air and electric lines between the superstructure and the lower main frame.
Figure 27:
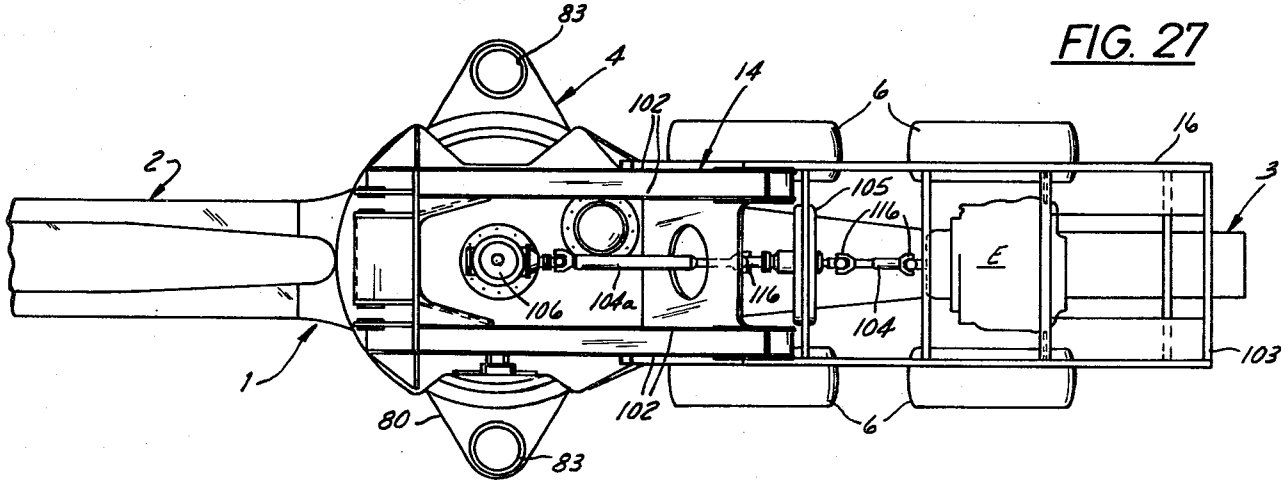
FIG. 27 is a plan view of a portion of the crane shown in FIG. 23, the view being taken generally from the line 27—27 in FIG. 23, but certain parts being removed for the sake of clarity.

As shown clearly in FIGS. 23–25, the superstructure 14 is rotatably mounted on an anti-friction bearing 98A (FIG. 23) which ride on the flat bearing ring 99 (FIGS. 4, 11, 18, and 20) welded to the upper side of the tub. The superstructure includes a circular segmented base plate 101 having welded thereto a pair of spaced apart double walled members 102 which extend generally off to one side of the superstructure as shown in FIG. 24 shows this better. The superstructure also includes the cantilevered framework 16 which is fabricated by welding a series of tubular members 103 together as shown clearly in FIG. 24. The engine E is located outwardly in the overhanging framework 16 and provides power sources for driving the ground engaging wheels. The longitudinal centerline of the engine is located on the lengthwise centerline of the superstructure to balance the engine weight and torque reactions equally on both sides. Further symmetry and weight balance is attained by locating the hydraulic tank 26 on the side opposite from fuel tank 27.

The engine is located as far outwardly as possible in the framework 16 for counterbalancing the boom in the crane operating mode. Other essential components are also mounted on the superstructure framework, such as previously mentioned engine, compressor, fuel tanks and winches and also counterbalance the boom 20, thereby avoiding the necessity of conventional counterweights.

Power can thus be taken directly from the standard rear crankshaft position of the engine directly by the connecting shaft 104, through a hydraulic pump 105, which furnishes power to the upper crane functions, and through the shaft **104*a* and then into the conventional right angular gear box 106. The right angular gear box includes the conventional bevelled gear sets 106*a* which drives a vertically disposed power shaft 107 that extends centrally through the tub and whose lower end is connected to another right angled bevelled gear drive 108 located beneath the main frame. Power is then transmitted from the right angle gear drive 108 to the clutch 110 and into the transmission 111 of the power transmission. Universally jointed shafts 112 and 113 then convey the power to the differentials 114 and 115** of the ground wheels in the conventional manner.

Figure 26:
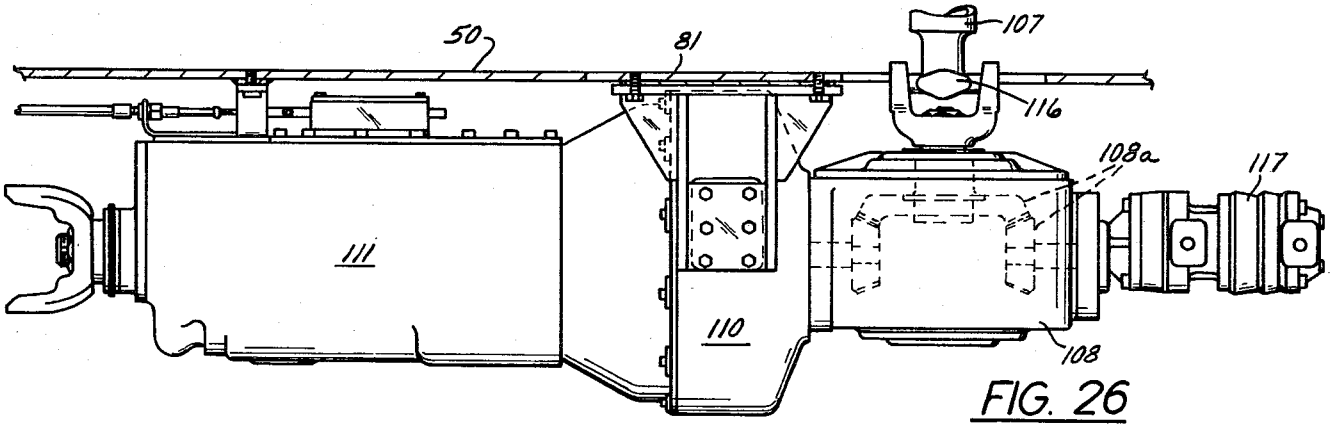
FIG. 26 is a side elevational, enlarged view of the transmission and clutch shown in FIG. 23.

A hydraulic pump 117 (FIGS. 23, 26), driven by bevelled gear set **108*a***, is located beneath the main frame and furnishes power for operation of the outriggers described in said pending application Ser. No. 203,942.

Universal joints 116 at the ends of shafts 104, **104*a* and 107 permit a certain amount of misalignment and permit the use of an open center construction between the superstructure and main frame, including tube 123 extending downwardly into the tub, and an air swivel and collector ring 121**, now to be described.

FIG. 25 shows the means for forming a rotary connection, between the superstructure and the main frame, for the compressed air and electric lines. The air compressor 25 mounted on and driven by the engine furnishes compressed air to the brake system (not shown) for the wheels on the main frame. This compressed air is conveyed through the larger annular groove or passage 122 formed on the periphery of the tube 123 fixed to the lower plane 101 of the superstructure. The tube 123 is secured to plate 101 along with the housing 124 of the upper right angle gear drive 106 by bolt means 126 which threadable engage the plate 101. Another smaller air passage 128 is formed by the annular groove around the tube 123 and provides a passage for air coming from the lower air throttle (not shown) actuated from the operator's cab 40 (when in the transport mode) and conveys this air back to the engine. Suitable grooves and o-ring seal means 130 are also provided between the tube 123 and a collar 134.

An electrical collector ring 138 acts in cooperation with collar 134 to provide continuous electric power between the superstructure and the main frame via the electrical connectors 140 which are electrically secured to collector 138 and also to the ring 133 and electric wires 145 connected thereto. Relative rotation is permitted between collector ring 134 and ring 138 to provide continuous electrical contact. A series of circumferentially spaced, vertical struts 148 secured intermediate their length to the upper plate 81 of the tub, act to prevent rotation of the collar 134 by means of the interengaging slot and pin connections 150 and also act to prevent rotation of the lower ring 144 to which they are attached.

The above described rotary connection between the air and electric lines permit considerable misalignment from the superstructure to the main frame, both in the vertical and horizontal directions, and acts as a vibration mounting system therebetween.

We claim:

1. An elongated main frame for a truck crane, said frame comprising, a tubular front portion and a tubular rear portion both of rectangular transverse cross section throughout their length and fabricated from steel plates including a top plate, a bottom plate, and two vertical side plates welded together, said front and rear portions terminating, respectively, in an outer front end and an outer rear end, said portions each having at least part of their side plates tapering toward one another and to a smaller transverse cross sectional area towards their said front and rear ends, said frame including a vertically positioned cylindrical tub located between and rigidly secured to said portions, said tub being of generally circular shape when viewed in plan, attaching means on said frame for attaching ground engaging means along the lower side of said frame, means carried by said front and rear ends of said frame for mounting vertically positionable ground engaging jacks.

2. The main frame set forth in claim 1 further characterized in that said tub includes a cylindrical steel member having its axis disposed in a vertical direction, a pair of spaced apart vertical plates extending longitudinally across and welded to the interior of said cylindrical steel member, said vertical side plates of said portions being in longitudinal alignment with said vertical plates in said cylindrical member to form a pair of continuous vertical side walls along the length of said main frame.

3. The main frame set forth in claim 2 further characterized in that said tub includes a horizontal plate secured across the top of said tub and also a horizontal plate secured across the bottom of said tub, said horizontal plates extending transversely beyond each side of said tub, and a steel tube welded between said extending upper and lower plates at each side of said tub to thereby provide pivotable mounting means for mounting outriggers at each side of said main frame.

4. The main frame set forth in claim 2 including a pair of spaced apart vertical plates extending transversely within said cylindrical member and intersecting said longitudinally extending vertical plates in said member, said transversely extending plates welded to said longitudinally extending plates in said tub and also welded to the interior of said tub.

5. The main frame set forth in claim 1 further characterized in that said tub includes a horizontal plate secured across the top of said tub and also a horizontal plate secured across the bottom of said tub, said horizontal plates extending transversely beyond each side of said tub, and a steel tube welded between said extending upper and lower plates at each side of said tub to thereby provide pivotable mounting means for mounting outriggers at each side of said main frame.

6. The main frame set forth in claim 1 further characterized in that said front and rear portions each having reinforcing plates welded along their upper sides and generally co-extensive in length therewith, said reinforcing plates converging in width as they approach said outer ends of said portions.

7. An elongated main frame for a truck crane, said frame comprising, a tubular front portion and a tubular rear portion both of rectangular transverse cross section throughout their length and fabricated from steel plates including a top plate, a bottom plate and two vertical side plates welded together, said front and rear portions terminating, respectively, in an outer front end and an outer rear end, said portions each having at least part of their side plates tapering toward one another and to a smaller transverse cross sectional area towards their said front and rear ends, said frame including a vertically positioned cylindrical tub located between and rigidly secured to said portions, said tub including a cylindrical steel member having its axis disposed in a vertical direction, a pair of spaced apart vertical plates extending longitudinally across and welded to the interior of said cylindrical steel member, said vertical side plates of said portions being in longitudinal alignment with said vertical plates in said cylindrical member to form a pair of continuous vertical side walls along the length of said main frame, a pair of spaced apart vertical plates extending transversely within said cylindrical member and intersecting said longitudinally extending vertical plates in said member, said transversely extending plates welded to said longitudinally extending plates in said tub and also welded to the interior of said tub; said tub also including a horizontal plate secured across the top of said tub and also a horizontal plate secured across the bottom of said tub, said horizontal plates extending transversely beyond each side of said tub, and a steel tube welded between said extending upper and lower plates at each side of said tub to thereby provide pivotable mounting means for mounting outriggers at each side of said main frame, attaching means of said frame for attaching ground engaging means along the lower side of said frame, means carried by said front and rear ends of said frame for mounting vertically positionable ground engaging jacks.

8. The frame according to claim 7 further characterized in that said portions each taper to a smaller transverse cross sectional area towards their respective said outer end, and reinforcing plates welded along the upper sides of said front and rear portions and generally co-extensive in length therewith, said reinforcing plates converging in width as they approach said outer ends of said portions to thereby provide a good strength-to-weight ratio for said main frame.

9. A truck crane comprising, an elongated main frame having a front portion and a rear portion both of rectangular, tubular shape throughout their length and fabricated from steel plates including a top plate, a bottom plate, and two vertical side plates welded together, said front and rear portions terminating, respectively, in a front end and a rear end, said portions each having at least part of their side plates tapering toward one another and to a smaller transverse cross sectional area towards their said front and rear ends, said frame including a vertically positioned cylindrical tub located between and rigidly secured to said portions, said tub being of generally circular shape when viewed in plan, ground engaging means located along the lower side of said frame portions for supporting said crane for travel over the terrain, vertically positionable jacks mounted adjacent said front and rear ends of said frame and engageable with the terrain for rigidly supporting said front and rear ends of said frame on said terrain whereby said frame acts as both a front and rear outrigger for said crane, a transverse outrigger for each transverse side of said frame and each outrigger pivotally connected about a vertical axis to said tub, each of said outriggers being swingable about said axis between (1) a position alongside said frame and clear of said terrain for a crane transport mode and (2) a position extending transversely outwardly of said frame in terrain contact at the outer end of said outrigger for stablizing said crane against lateral tipping in a crane operative mode, an upper superstructure rotatably mounted on said tub for rotation about a vertical axis, and a boom mounted on said superstructure about a horizontal axis for vertical swinging of said boom relative to said superstructure and for horizontal rotation therewith.

10. The crane described in claim 9 wherein said outriggers each have an inner end pivotably connected about said vertical axis, said inner end being bifurcated into an upper part and a lower part located, respectively, above and below said tub, and a pivot shaft extending through said parts and said tub and about which said outriggers can pivot, whereby said parts are vertically spaced apart to provide a stable connection for said outriggers to said tub, said outriggers each having an outer end, and a vertically positionable ground engaging jack located at each of said outer ends of said outriggers.

11. The crane set forth in claim 10 further characterized in that said tub includes a horizontal plate secured across the top of said tub and also a horizontal plate secured across the bottom of said tub, said horizontal plates extending transversely beyond each side of said tub, and a steel tube welded between said extending upper and lower plates at each side of said tub to thereby provide pivotable mounting means for receiving said pivot shaft for mounting outriggers at each side of said main frame.

12. The crane set forth in claim 9 further characterized in that said circular tub includes a cylindrical steel member having its axis disposed in a vertical direction, a pair of spaced apart vertical plates extending longitudinally across and welded to the interior of said cylindrical steel member, said vertical side plates of said portion being in longitudinal alignment with said vertical plates in said cylindrical member to form a pair of continuous vertical side walls along the length of said main frame.

13. The crane set forth in claim 12 including a pair of spaced apart vertical plates extending transversely within said cylindrical member and intersecting said longitudinally extending vertical plates in said member, said transversely extending plates welded to said longitudinally extending plates in said tub and also welded to the interior of said tub.

14. The crane set forth in claim 9 further characterized in that said tub includes a horizontal plate secured across the top of said tub and also a horizontal plate secured across the bottom of said tub, said horizontal plates extending transversely beyond each side of said tub, and a steel tube welded between said extending upper and lower plates at each side of said tub to thereby provide pivotable mounting means for mounting said outriggers at each side of said main frame.

15. The crane set forth in claim 9 further characterized in that said front and rear portions each having reinforcing plates welded along their upper sides and generally co-extensive in length therewith, said reinforcing plates converging in width as they approach said outer ends of said portions to thereby enhance the strength-weight ratio of said portions.

16. The crane set forth in claim 9 further characterized in that said superstructure includes a cantilevered framework overhanging at one side of said superstructure, said power source mounted on said overhanging framework, power transmission means secured along the underside of said main frame and connected to said ground engaging means for driving the latter, a vertically disposed power shaft extending through said tub, right angle drive means connected between said transmission means and the lower end of said power shaft, and another right angle drive means connected between the upper end of said power shaft and said power source, said boom extending outwardly from the opposite side of said superstructure from that of said framework whereby said power source tends to counterbalance said boom.

17. The crane set forth in claim 16 including a tubular member in said tub and around said power shaft and forming a rotary connector for conducting compressed air and electrical wires between said main frame and said superstructure.

18. A self-propelled truck crane comprising, an elongated main frame having a front portion and a rear portion both of tubular and rectangular transverse cross section throughout their length and fabricated from sheet steel plates including a top plate, a bottom plate and two vertical side plates welded together, said front and rear portions terminating, respectively, in a front end and a rear end, said portions each having at least part of their side plates tapering toward one another and to a smaller transverse cross sectional area towards their said front and rear ends, said frame including a vertically positioned cylindrical tub located between and rigidly secured to said portions, said tub being of generally circular shape when viewed in plan, a superstructure rotatably mounted on said tub for rotation about a vertical axis, a telescoping boom mounted on said superstructure about a horizontal axis for vertical swinging of said boom relative to said superstructure and for horizontal rotation therewith, ground engaging means located along the lower side of said frame portions for supporting said crane for travel over the terrain, a power source connected to at least some of said ground engaging means for rotatably driving the latter and consequently said crane, vertically positionable jacks mounted adjacent said front and rear ends of said frame and engageable with the terrain for rigidly supporting said front and rear ends of said frame on said terrain whereby said frame acts as both a front and rear outrigger for said crane, and a transverse outrigger for each transverse side of said frame and each outrigger pivotally connected about a vertical axis to said tub, each of said outriggers being swingable about its said axis between (1) a position alongside said frame and clear of said terrain for a crane transport mode and (2) a position extending transversely outwardly of said frame and in terrain contact at the outer end of said outrigger for stabilizing said crane against lateral tipping in a crane operative mode, each of said transverse outriggers being telescopingly extendible.

19. The self-propelled truck crane as described in claim 18 wherein said superstructure includes a cantilevered framework overhanging at one side of said superstructure, a power source mounted on said overhanging framework, power transmission means secured to and along the underside of said main frame and connected to said ground engaging means for driving said crane, a vertically disposed power shaft extending through said tub, right angle drive means connected between said transmission means and the lower end of said power shaft, and another right angle drive means connected between the upper end of said power shaft and said power source, said boom extending outwardly from the opposite side of said superstructure from that of said framework whereby said power source tends to counterbalance said boom.

20. The crane set forth in claim 19 including a tubular member in said tub and around said power shaft and forming a rotary connector for conducting compressed air and electrical wires between said main frame and said superstructure.

21. A self-propelled truck crane comprising, an elongated main frame having a front portion and a rear portion both of tubular and rectangular transverse cross section throughout their length and fabricated from steel plates including a top plate, a bottom plate and two vertical side plates welded together, said front and rear portions terminating, respectively, in a front end and a rear end, said portions each having at least part of their side plates tapering toward one another and to a smaller transverse cross sectional area towards their said front and rear ends, said frame including a vertically positioned cylindrical tub located between and rigidly secured to said portions, said tub being of generally circular shape when viewed in plan, a superstructure rotatably mounted on said main frame for rotation about a vertical axis, a telescoping boom mounted on said superstructure about a horizontal axis for vertical swinging of said boom relative to said superstructure and for horizontal rotation therewith over a 360 degree range, vertically positionable jacks mounted adjacent said front and rear ends of said frame and engageable with the terrain for rigidly supporting said front and rear ends of said frame on said terrain whereby said frame acts as both a front and rear outrigger for said crane, and a transverse outrigger for each transverse side of said frame and each outrigger pivotally connected about a vertical axis to said main frame at a location about 60 percent closer to said rear end than to said front end, each of said outriggers being swingable about its said axis between (1) a position alongside said frame and clear of said terrain for a crane transport mode and (2) a position extending transversely outwardly of said frame and in terrain contact at the outer end of said outrigger for stabilizing said crane against lateral tipping in a crane operative mode, each of said transverse outriggers being telescopingly extendible, said outriggers being fixedly positioned at angles of about 65 degrees, 79 degrees and 108 degrees from the longitudinal centerline of the rear portion of the main frame when the boom is working, respectively, generally over the rear portion of the main frame, through a 360 degree operation of the boom over the main frame, and over the front portion of the main frame.

* * * * *